US008181289B2

(12) United States Patent
Schmitt et al.

(10) Patent No.: US 8,181,289 B2
(45) Date of Patent: May 22, 2012

(54) SINK WITH PRE-PLUMBED AND CO-LOCATED COMPONENTS

(75) Inventors: Paul A. Schmitt, Chicago, IL (US); Richard A. Nortier, Westchester, IL (US); Mark Gutting-Kilzer, Des Plaines, IL (US); James C. Allen, Chicago, IL (US)

(73) Assignee: Sloan Valve Company, Franklin Park, IL (US)

( * ) Notice: Subject to any disclaimer, the term of this patent is extended or adjusted under 35 U.S.C. 154(b) by 1040 days.

(21) Appl. No.: 11/948,882

(22) Filed: Nov. 30, 2007

(65) Prior Publication Data

US 2008/0127410 A1 Jun. 5, 2008

Related U.S. Application Data

(60) Provisional application No. 60/867,865, filed on Nov. 30, 2006.

(51) Int. Cl.
*A47K 1/04* (2006.01)

(52) U.S. Cl. ..... 4/619; 4/623; 4/638

(58) Field of Classification Search ..... 4/623, 619, 4/638

See application file for complete search history.

(56) References Cited

U.S. PATENT DOCUMENTS

| | | | | | |
|---|---|---|---|---|---|
| 3,728,745 | A | * | 4/1973 | Brendgord et al. | 4/624 |
| 3,992,730 | A | * | 11/1976 | Davis | 4/624 |
| 4,072,157 | A | * | 2/1978 | Wines et al. | 134/58 R |
| 4,398,310 | A | * | 8/1983 | Lienhard | 4/623 |
| 4,606,085 | A | * | 8/1986 | Davies | 4/623 |
| 4,942,631 | A | * | 7/1990 | Rosa | 4/623 |
| 5,369,818 | A | * | 12/1994 | Barnum et al. | 4/624 |
| 5,611,093 | A | * | 3/1997 | Barnum et al. | 4/624 |
| D447,224 | S | * | 8/2001 | Barnum et al. | D23/308 |

* cited by examiner

*Primary Examiner* — Gregory Huson
*Assistant Examiner* — Karen L Younkins
(74) *Attorney, Agent, or Firm* — Cook Alex Ltd.

(57) ABSTRACT

A lavatory system has a cabinet including a base, a basin and a head extending above the basin. A water outlet/sensor is mounted in the head. A water supply line is connected to the water outlet. A solenoid valve in the water supply line controls the flow of water through the water supply line. A circuit board sends electrical signals to the solenoid valve for opening and closing the valve upon receipt of indications from a sensor as to whether a user hands is present or not. The solenoid valve, shut off valve, circuit board and sensor are mounted in the head with a sloped surface towards the basin. A manual shutoff valve mounted in the head is included in the supply line.

12 Claims, 6 Drawing Sheets

SINK WITH PRE-PLUMBED AND CO-LOCATED COMPONENTS

CROSS REFERENCE TO RELATED APPLICATION

This application claims the benefit of U.S. provisional application No. 60/867,865 filed Nov. 30, 2006.

BACKGROUND OF THE INVENTION

Commercial lavatory systems typically include a cabinet with a basin either installed or integrally formed in the cabinet's deck. The cabinet has a base portion fastened to a fabricated metal frame and supporting the basin at a convenient height for users. The cabinet may also include a head or island portion located behind and above the basin. One or more water outlets are mounted in the head and connected to suitable water supply pipes and solenoid-activated valves. Electronic sensors are similarly mounted in the head portion to detect a user and activate the valves to turn on the water.

Current lavatory design are not much more than a standard sink without much thought given to why components are located where they are. Neither is much thought given to how the components can be effectively relocated for additional benefit to both the contractor who will install the unit and service personnel who are responsible for on going maintenance. For example, the solenoid valves are typically located below the basin, requiring more work on or near the floor. Also, to adjust the sensor range control the installer needs to access the items from below the basin, on his knees with one hand on the range control and the other in the basin acting as a target for adjustment. Major serviceable components are located below the basin. Locating the components below the basin, while conventional from an installation perspective, makes servicing the unit difficult as there are access panels and additional support framing that make servicing the units unnecessarily challenging.

SUMMARY OF THE INVENTION

The present invention is directed to a lavatory system that is easier to install and service than prior art designs, resulting in a user-friendly device for hand hygiene.

In the lavatory system of the present invention many of the items associated with the operation of a hands-free wash basin, including the electronics and plumbing components, have been relocated from the traditional location in the base of the cabinet to an enclosed head above the basin. This design moves all electronics (except an optional low voltage transformer for code and safety reasons) along with the solenoid control valves to the area directly above and adjacent the basin. This also includes adding a local shut-off feature in the head, to make servicing the plumbing components simpler. There will be no reason to access the cabinet base even to turn off the water.

Mechanical improvements in the present invention further include converting the sensing protocol from body bounce to "on demand", ensuring that the faucet turns on only when desired and not when someone walks past the lavatory or stops at the lavatory. This saves water and eliminates the end user impression that the technology is not reliable. The sensor is mounted downward towards the rear of the water stream within an insert assembly that also houses the water outlet. The insert which mounts within the lowest elevation of the upper head assembly, has water passage channels that allow any small liquid leaks within the head assembly to harmlessly drain into the basin below. For the installer/contractor, the frame and housing components (basin, end caps, and front panel) are totally disjointed in the installation process. Once the frame is installed, the housing components can be fastened to the frame. The frame rails on the frame have been designed to account for where and how the installer anchors the frame to the wall. These improvements alone permit a single individual to install the lavatory, thereby reducing the installation labor costs.

An additional improvement that benefits the installer and service personnel is that all electronic and water control devices (e.g., solenoid valves and ball valve shut off) have been relocated to the upper head and are supplied factory installed. This further reduces installation time as only a single line needs to be run from the stop (which is located in the wall but still below the basin to fit standard rough-in procedures) to the upper head assembly and attached to the supplied ball valve. Similarly, a single two-lead power wire is run from the transformer (located below the basin) to the first circuit board in the upper head. Once powered up the faucet sensor range can easily be adjusted from the sink top. An electrical tether is used to permit more remote location of the sensors from the circuit board, which in turn facilitates on demand activation. All electronic devices within the upper head are positioned onto standoffs molded into the upper head bottom surface making sure that any unexpected water leaks drain below the electronic components towards the insert water passage channels via a sloped deck down into the basin. Periodic servicing of solenoids allows small amounts of water entrapped in the water passages to harmlessly flow into the basin.

This also means that when the solenoid screens need to be cleaned, the service person removes the lid and turns the water off using the ball valve, relieves the pressure in the local system and proceeds with the service. With the control module located in the upper head, all diagnostics are conveniently located for troubleshooting sensor range and electronic continuity. The service person no longer has to get on his knees and remove the front access panel. If he does, however, need front panel access for some other purpose, even that has been improved. Rather than sliding out sideways, which can be difficult in a corner, the front panel is attached by a hanging lip at the top edge and fastened at the bottom by several hidden fasteners. This construction provides a clean appearance, is not prone to vandalism, and is easy to remove and install. The lid attachment is achieved by using a standard latch with obscured releases.

When soap is an option the dispenser tray is filled through an opening in the top of the lid. An overflow is included in the tray in the event that too much soap is poured. The overflow can be easily removed for cleaning as can the entire tray by simply lifting off the supply tube. Should a soap overflow condition occur, the upper head angling frontal towards the basin, safely drains the overflow into the sink basin, one of the benefits of having the liquids in an upper head configuration over the basin deck. The soap actuator is positioned for horizontal activation which is more ergonomic than vertical operation. The human interface has been significantly enlarged distributing the force load over a broad surface of the palm. The present invention has also been designed to better accommodate the requirements of the American with Disabilities Act with respect to the mounting height, recognizing the need for flexibility.

DETAILED DESCRIPTION OF THE INVENTION

Figure 1:
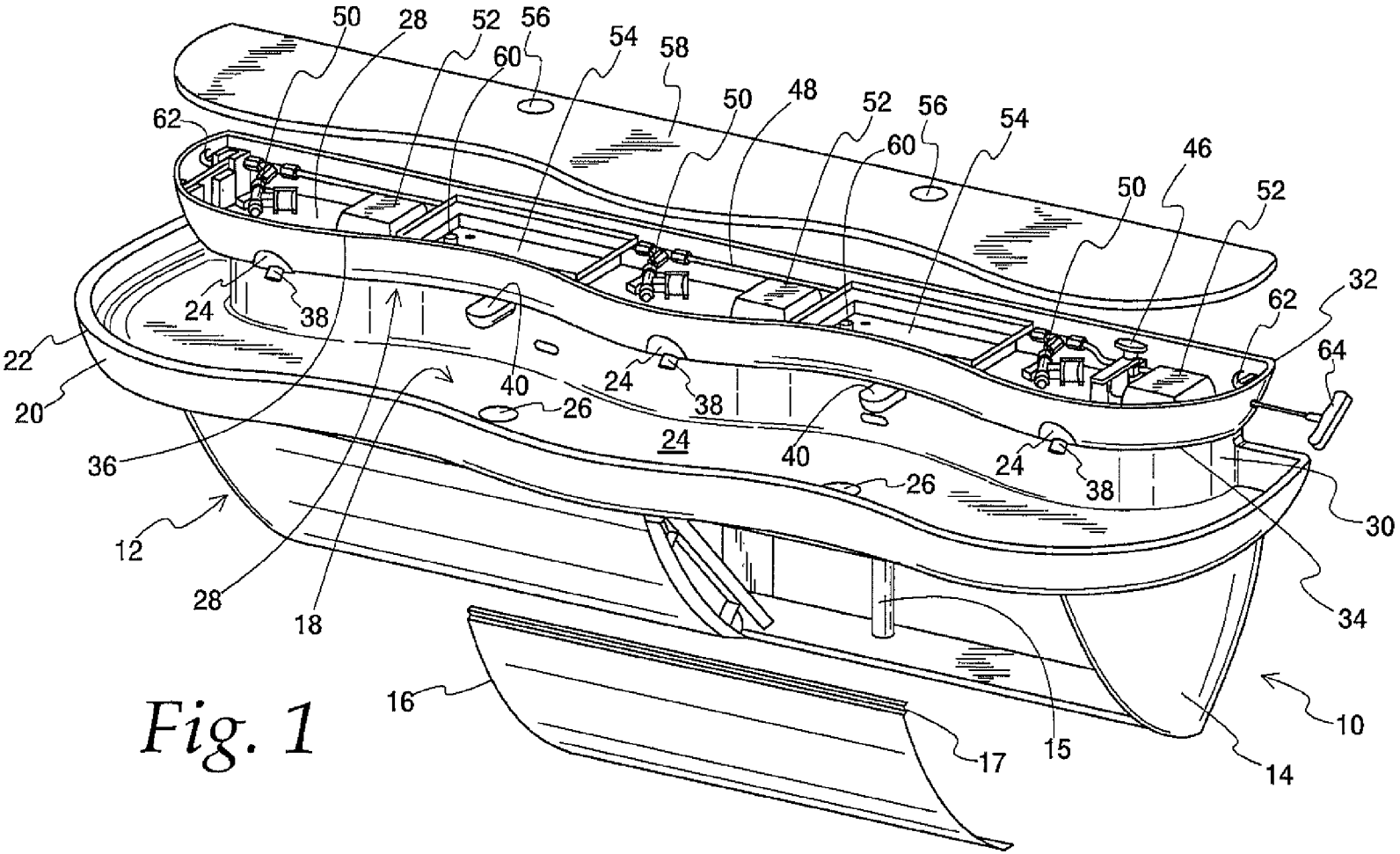
FIG. 1 is a perspective, exploded view of a lavatory system according to the present invention, showing a three-station lavatory.
Figure 5:
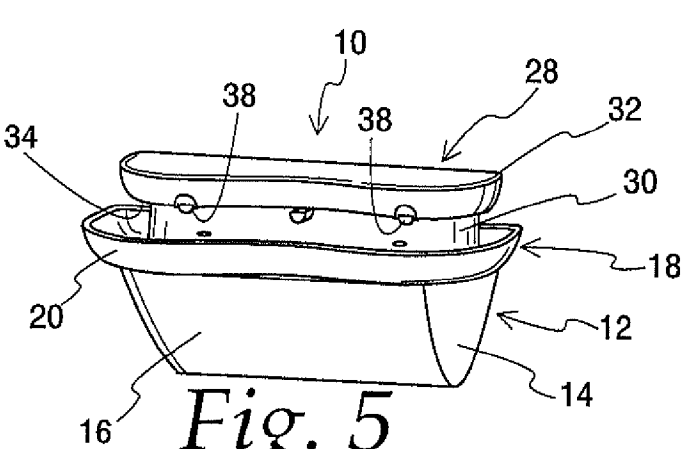
FIG. 5 is a perspective view of the lavatory of FIG. 2.
Figure 4:
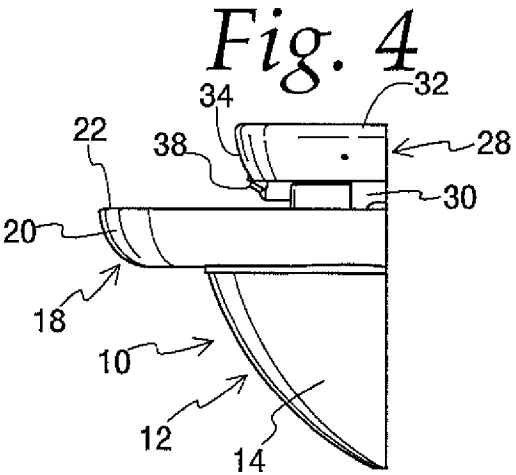
FIG. 4 is a side elevation view of the lavatory of FIG. 2.

FIG. 1 illustrates the lavatory system 10 of the present invention. The lavatory 10 includes a cabinet shown generally at 12. The cabinet includes a base portion 14 that fastens to a frame 15 and supports the lavatory. The frame 15 fastens to the wall forming the primary support system. A front access panel 16 is formed in the front of the base portion. The front access panel 16 is attached by a hanging lip at the top edge 17 and is fastened at the bottom by several hidden fasteners. The base portion 14 fastens to the frame 15. The frame substructure is separate from the cabinet pieces. This allows a sole installer to mount the frame and assemble the cabinet pieces. This is dramatically different from the prior art method that must have two people mount an entire, singular unit as it is one huge piece. In the present invention the individual cabinet pieces match up to pre-drilled holes in the frame 15 which enables a single installer to mount the cabinet pieces.

At that top of the base portion there is a basin 18. In the illustrated embodiment the basin 18 has a curved wall 20 that defines three wash stations, each with its own faucet. It will be understood that a different number of wash stations and faucets could be provided. Also, while the basin as shown provides only a minimal deck area on the top land 22 of the basin wall 20, a larger deck area could be provided. The interior of the basin floor is sloped from a central plateau 24 downwardly toward drain openings 26. The drain openings are, of course, connected to suitable waste pipes (not shown). The inside deck 28 of the upper head assembly is angled to allow gravitational flow of any liquid that may have leaked within the upper head assembly. The leak path flow down through openings at the faucet units 42.

Figure 2:
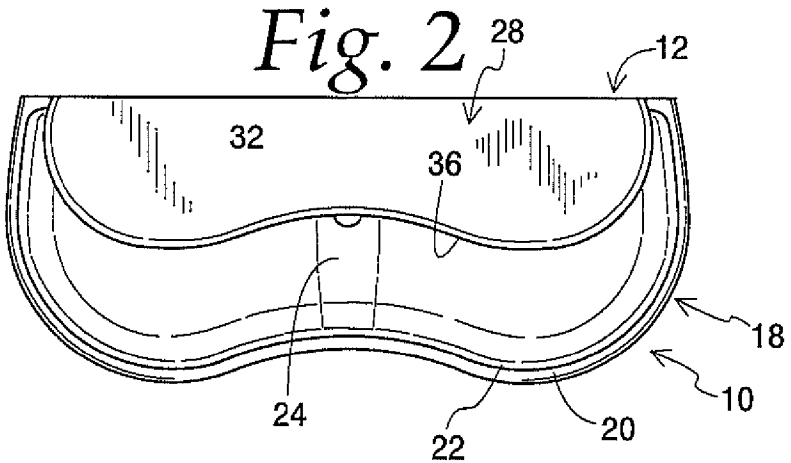
FIG. 2 is a top plan view of an alternate embodiment of the lavatory, showing a two-station unit.
Figure 3:
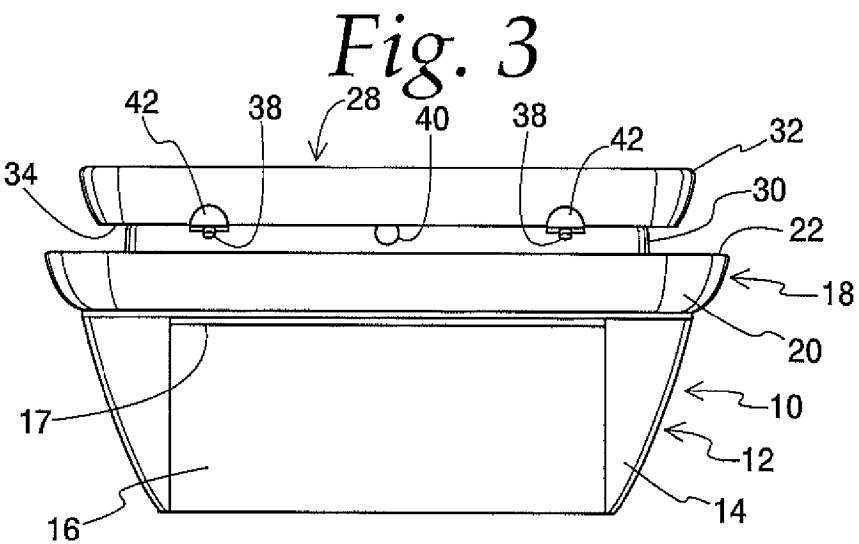
FIG. 3 is a front elevation view of the lavatory of FIG. 2.
Figure 8:
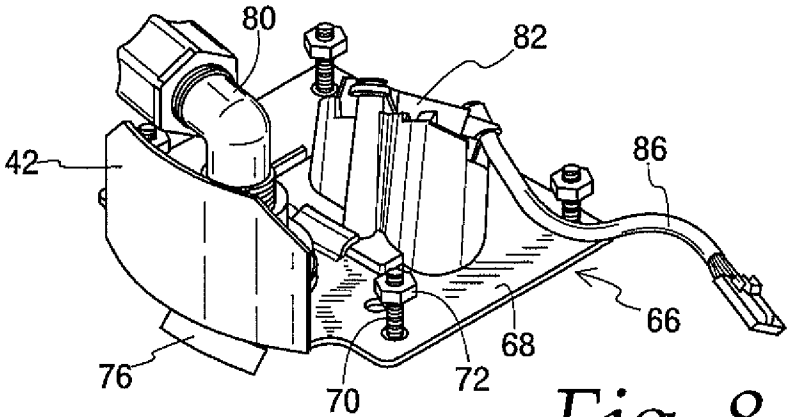
FIG. 8 is a front perspective view of the faucet unit assembly.
Figure 7:
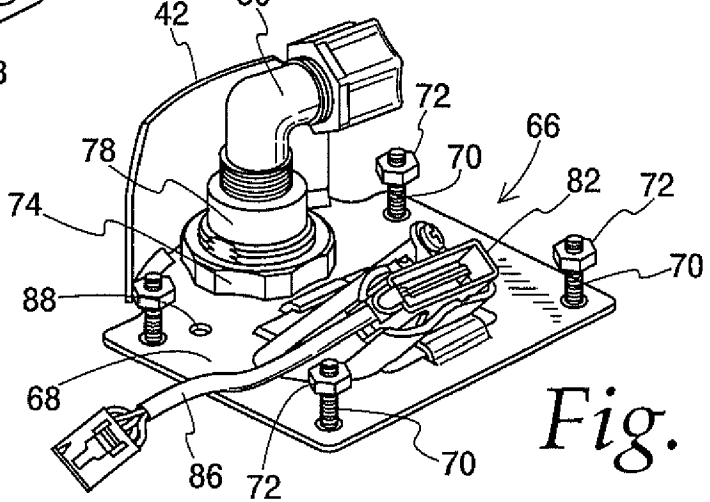
FIG. 7 is a rear perspective view of the faucet unit assembly.
Figure 6:
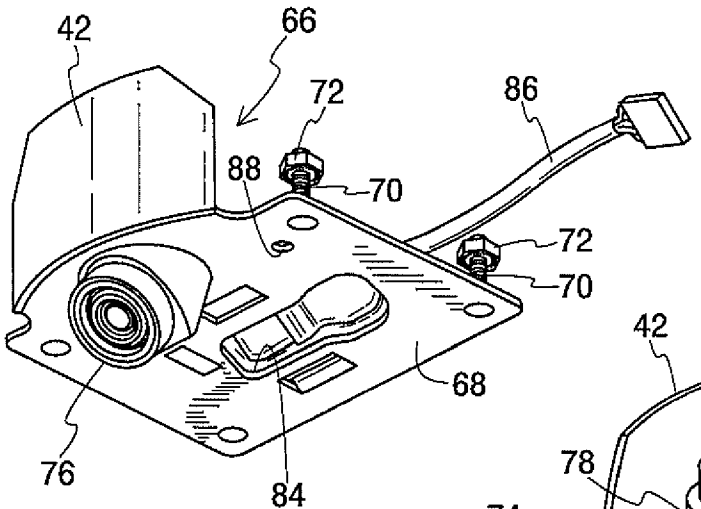
FIG. 6 is an underside perspective view of the faucet unit assembly.
Figure 9:
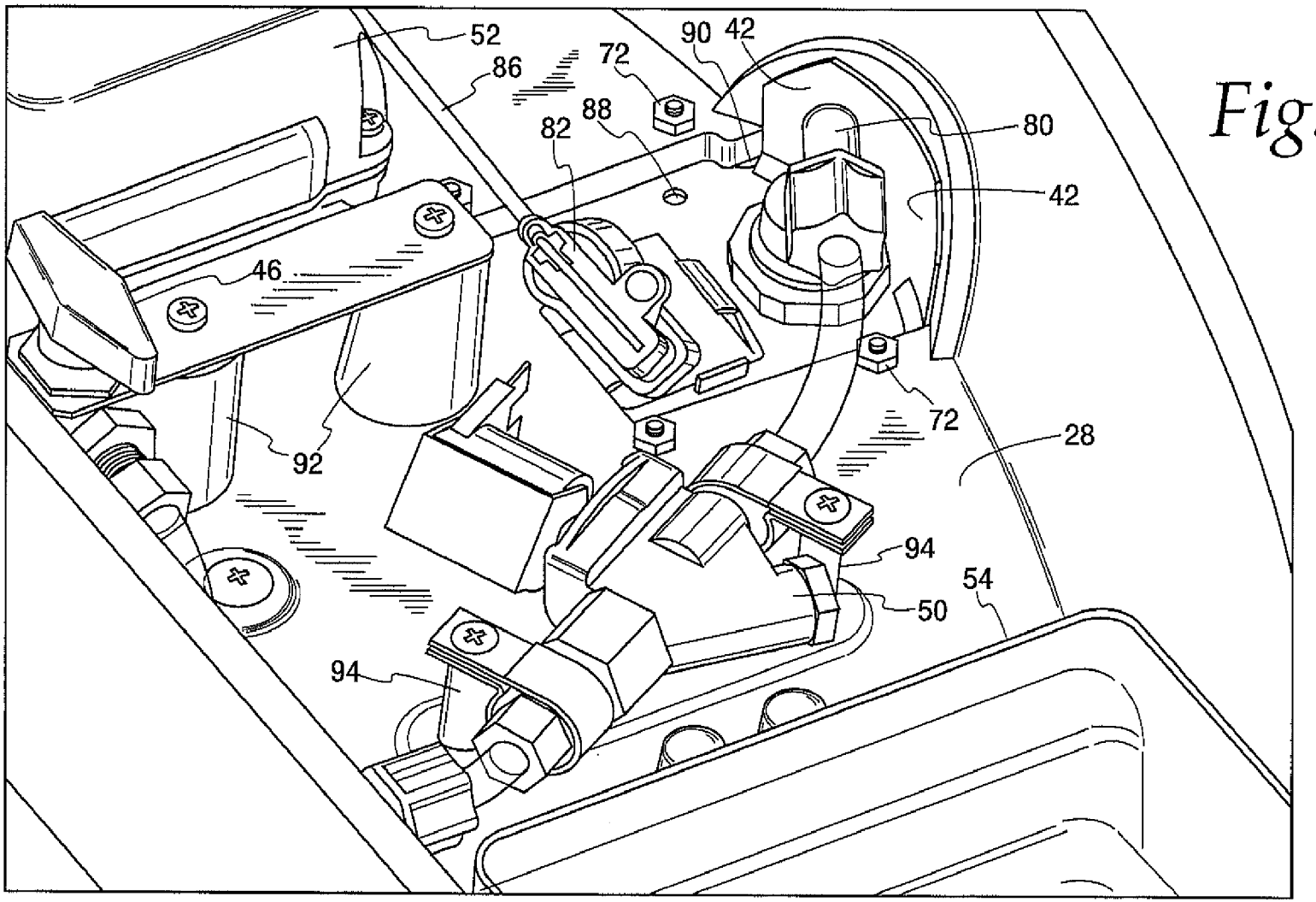
FIG. 9 is a perspective view, on an enlarged scale, of the components in the interior of the head.

The rear portion of the basin 18 is largely defined by an upstanding head or island shown generally at 28. In this embodiment the head has a lower portion 30 and an upper portion 32. The lower portion is integrally formed with the floor of the basin 18 and extends upwardly therefrom. The upper portion 32 extends in a horizontal sloping direction from the lower portion thereby forming an overhang 34 above the basin floor which is the low point from back to front. The front edge 36 of the overhang is curved to complement the shape of the basin wall 20, as best seen in FIG. 2. In this embodiment there are three water outlets 38 which protrude from the overhang 34 within the head assembly that also includes the sensing elements. An electronic sensor (not shown in this view) is associated with each water outlet for detecting the presence of a user's hands and opening a solenoid valve to supply water to the outlet. The solenoid valves, ball valves in the water supply lines, and the circuit boards for the sensors are all mounted slightly elevated in the interior of the inside deck 28 for ease of installation and servicing, as described above.

Two manual soap dispensers are shown at 40. Alternately, an electronic soap dispenser could be installed in the upper portion 32 of the head 28. Additionally a cover plate for each faucet unit is shown at 42. The illustrated cover plate is part of a faucet unit assembly fastened to the head. The faucet unit includes fixed sensing optics and connector leads, a water inlet connection, and a water outlet connection with a spray head. The head 28 may be made of a solid surface material with an opening in the overhang for receiving a faucet unit including the faucet spray head and the sensor assembly. The sensor is located behind the spray head and is not visible in the figures. This unit is preferably mounted on a stainless steel housing which includes a horizontal tray on the underside of the overhang and the generally vertical cover plate 42 on the front side of the overhang. It mounting location on the front edge 36 is at the apex of the curve so as to be at the closest point to the user.

The components in the interior of the head include the shut-off valve 46 which is installed in the water line 48. Solenoid valves 50 are mounted in water supply branch lines off of the main water line 48. The solenoid valves in turn are in fluid communication with the water outlets 38. An enclosure 52 is provided for each water outlet for housing the control circuit board which responds to the sensors and controls the solenoid valves 50. Two soap dispenser trays 54 may be filled through openings 56 in the top of the lid 58. An overflow 60 is included in each tray in the event that too much soap is added to the tray. The overflow drains down through the upper portion 32 into the lower portion 30. Top lid 58 is fastened onto upper portion 32 by two recessed lock mechanisms 62 which are secured with a tool 64 that engages the drive, inside the upper portion. The lock mechanisms are recessed in solid surface pockets 65. The rotation of the lock pulls the lid down, positively placing the top lid 58. No external fasteners are visible, lending to vandal resistance. The cover latches also secure the cover squarely so no movement is allowed horizontally. Further details of the lock mechanisms are described below.

FIGS. 2-5 illustrate an alternate embodiment of the lavatory of the present invention. This embodiment is similar in most respects to the version shown in FIG. 1 with the exception that it has two water outlets 38 and a single soap dispenser 40. Accordingly, common reference numerals are used to describe parts in common with the FIG. 1 embodiment.

Details of the faucet unit assembly 66 are shown in FIGS. 6-9. The assembly has a weldment including a base plate 68 and the front cover plate 42. The base plate is fastened to the upper portion 32 of the head 28 by bolts 70 and nuts 72. A locknut 74 joins a spray head 76 and a spray head adaptor 78 to the base plate. The spray head serves as the water outlet 38 referred to above. A compression elbow fitting 80 joins the spray head adaptor in fluid communication and is suitable for connection to a water supply branch line 81 (FIG. 10) coming from a solenoid valve 50. A sensor assembly 82 is mounted on the base plate 68 behind the locknut 74. There is an aperture 84 in the base plate aligned with the sensor optics. An electrical lead 86, which is shown schematically and not to scale, connects the sensor assembly to a control circuit board in one of the enclosures 52. A drain hole 88 is formed in the base plate 68. A drain passage is shown at 90 in FIG. 9. It will be noted that the components in the head are mounted on standoffs, such as shown at 92 for the shutoff valve 46 and at 94 for the solenoid valve 50. This raises the components off the inside deck 28 and thereby protects them from any leakage in the head. The components are fastened with threaded inserts molded into the solid surface material.

Figure 10:
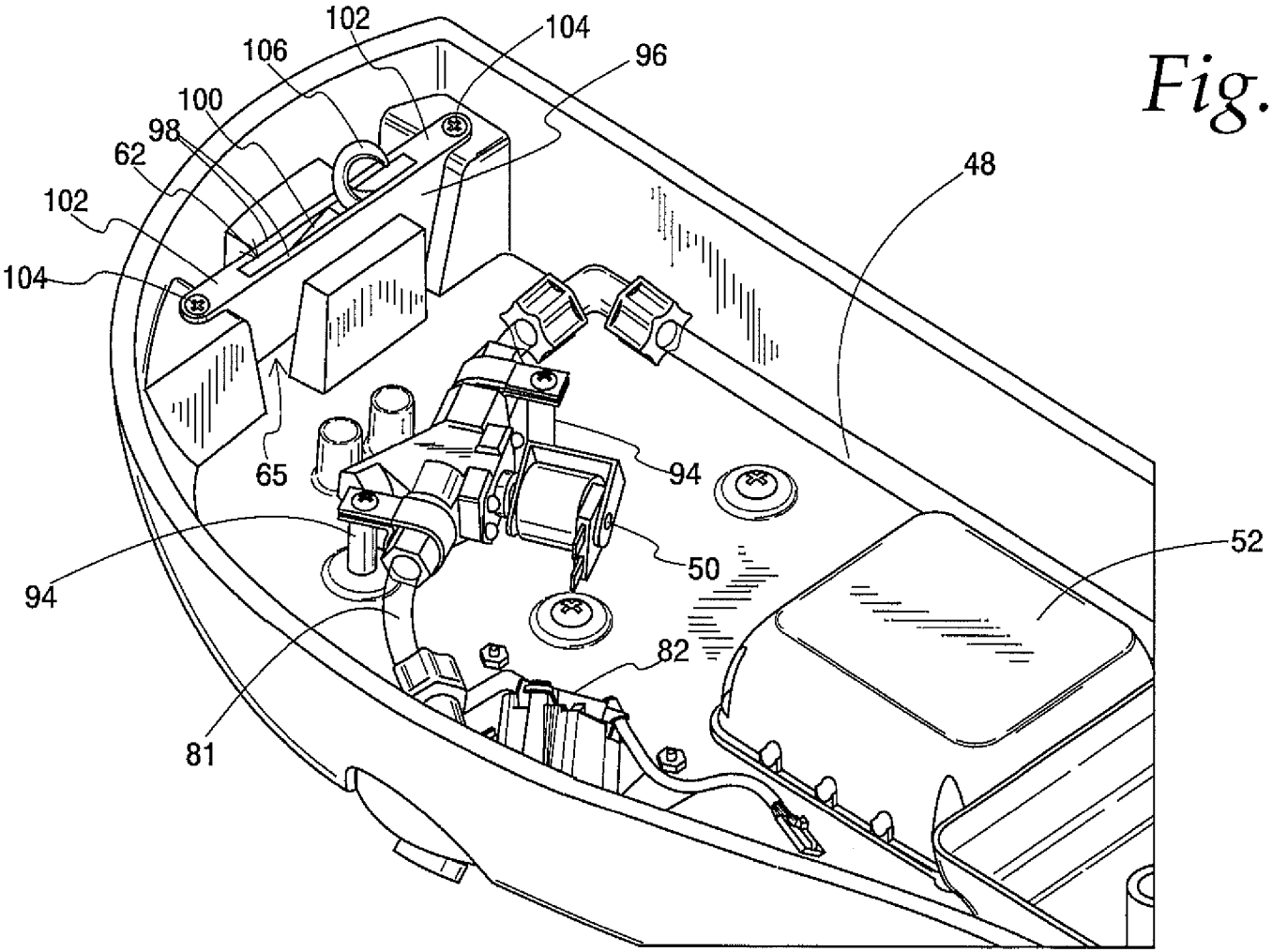
FIG. 10 is a perspective view of one end of the head, showing the cam lock.
Figure 11:
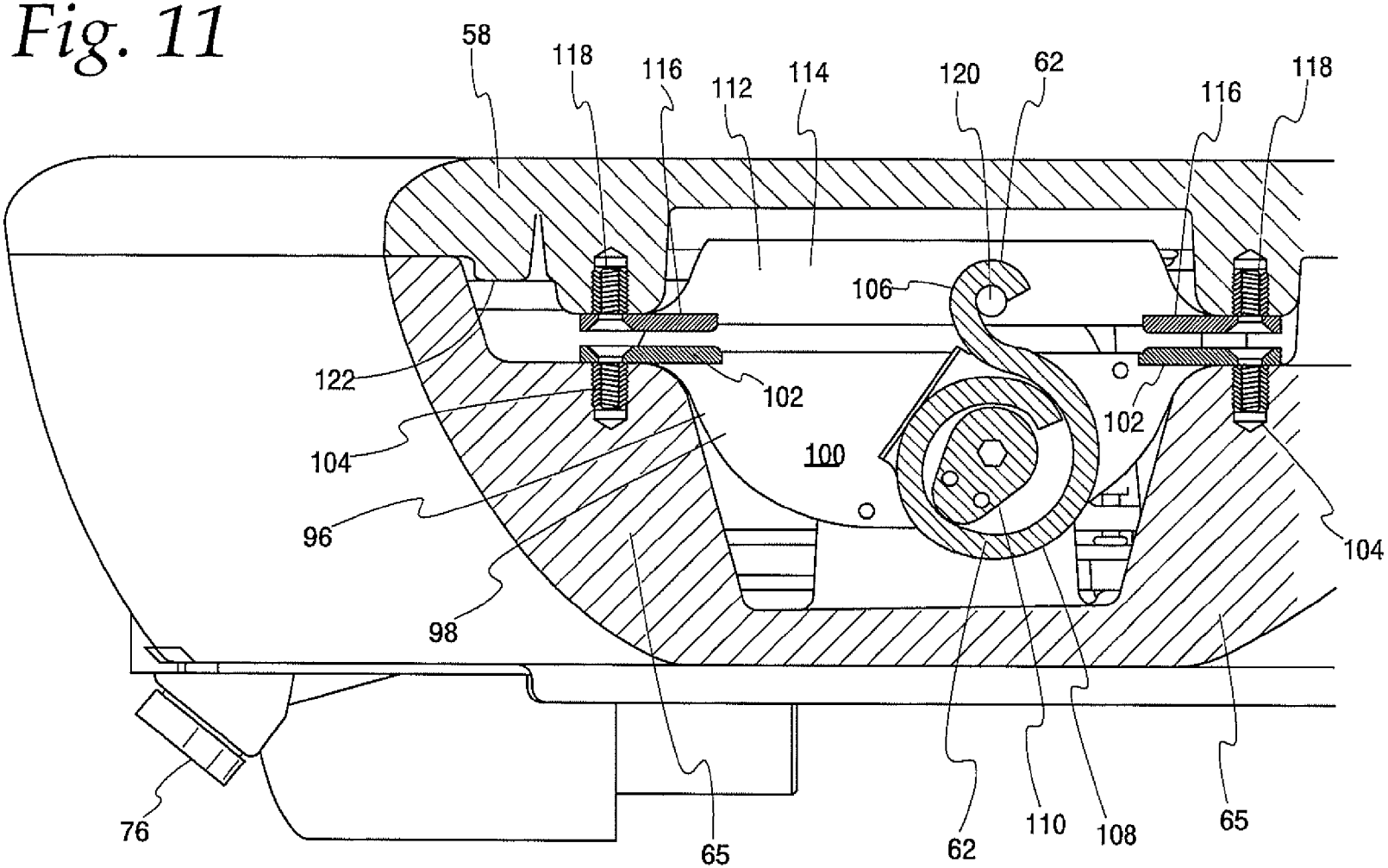
FIG. 11 is a section through one of the cam locks.

FIGS. 10 and 11 further illustrate the lock mechanisms 62 and solid surface pockets 65. The lock mechanism includes a lower bracket 96 mounted in the pocket 65 of the head. The lower bracket has a pair of spaced, vertical panels 98 which define a slot 100 between them. The panels are joined by two support bars 102 at their upper edges. The support bars are screwed into the pocket 65 by screws 104. The lower bracket rotatably mounts in the slot 100 a clasp which includes a hook 106 joined to a ring 108. The ring surrounds a cam 110. The cam is mounted for rotation between the panels 98 in the slot 100. The cam can be rotated by the tool 64 when the tool is inserted through an opening (not shown) in the head. Rotation of the cam rotates the ring 108 and in turn, the hook 106. An upper bracket 112 has a construction similar to the lower bracket in that it has a pair of spaced panels 114 joined to support bars 116. The support bars are fastened to the lid 58 by screws 118. A pin 120 is fixed to the panels 116. When the tool 64 rotates the clasp, the hook 106 can move into and out of engagement with the pin 120, depending on the direction of rotation. This tightens or loosens the lid on the head as desired.

The lid has a ridge or lip 122 on its underside, extending around the perimeter of the lid, although spaced inwardly somewhat from the very edge of the lid. The ridge 122 prevents horizontal movement of the lid when the lock mechanism is in the closed position. There is no gap between the lid and the head when the lock mechanism is secured. Since only a small hole in the head is needed for access by the tool 64 (which is essentially a T-shaped Allen wrench), vandals will not see any fasteners that could attract their attention.

While the preferred form of the invention has been shown and described herein, it should be realized that there may be many modifications, substitutions and alterations thereto.

We claim:

1. A lavatory comprising:

a cabinet;

a basin supported by the cabinet;

a head extending above the basin and comprising a bottom surface;

at least one water outlet mounted in the head;

a water supply line connected to the water outlet and including at least one water supply branch line with a solenoid valve for controlling flow through the water supply branch line;

a circuit board electrically connected to the solenoid valve for opening and closing said valve; and a sensor electrically connected to the circuit board for supplying a signal thereto when a user is detected, the solenoid valve, circuit board, sensor, and water supply branch line being mounted in the head above the basin and the cabinet, with the bottom surface of the head comprising a plurality of standoffs on which the solenoid valve, circuit board, and sensor are mounted in the interior of the head.

2. The lavatory of claim 1 wherein the head further comprises a lower portion and an upper portion which is sloped downwardly toward the basin whereby the slope allows the gravitational flow of any liquid that may have leaked from the upper portion into the basin below.

3. The lavatory of claim 1 wherein the water supply line further comprises a water shutoff valve mounted in the head.

4. The lavatory of claim 1 wherein the plurality of standoffs are molded into the bottom surface of the head.

5. The lavatory of claim 1 further comprising at least one soap dispenser mounted in the head.

6. A lavatory comprising:

a cabinet;

a basin supported by the cabinet;

a head extending above the basin;

at least one faucet unit assembly including a base plate, being mounted within a lowest elevation of the head, and having a drain hole, said faucet unit assembly further including a water outlet, a sensor, and at least one water passage channel;

a water supply line connected to the water outlet and having a solenoid valve for controlling flow through the water supply line;

a circuit board electrically connected to the solenoid valve for opening and closing said valve;

said sensor electrically connected to the circuit board for supplying a signal thereto when a user is detected, the solenoid valve and circuit board being mounted in the head above the basin and the cabinet.

7. The lavatory of claim 6 wherein the head further comprises a lower portion and an upper portion which is sloped downwardly toward the basin whereby the slope allows the gravitational flow of any liquid that may have leaked from the upper portion into the basin below through the water passage channel.

8. The lavatory of claim 6 wherein the solenoid valve and circuit board are mounted on a standoff in the interior of the head.

9. The lavatory of claim 6 wherein the water supply line further comprises a water shutoff valve mounted in the head.

10. The lavatory of claim 6 further comprising at least one soap dispenser mounted in the head.

11. The lavatory of claim 1 wherein the circuit board is mounted within an enclosure in the head and electrically connected to the sensor by an electrical lead.

12. The lavatory of claim 6 wherein the circuit board is mounted within an enclosure in the head and electrically connected to the sensor by an electrical lead

* * * * *